US009728348B2

(12) United States Patent
Zhou et al.

(10) Patent No.: US 9,728,348 B2
(45) Date of Patent: Aug. 8, 2017

(54) ELECTRICAL SWITCHING APPARATUS WITH ELECTRONIC TRIP UNIT

(71) Applicant: EATON CORPORATION, Cleveland, OH (US)

(72) Inventors: Xin Zhou, Wexford, PA (US); Frank Joseph Stifter, Jr., Coraopolis, PA (US); Gerald Zheng, Shanghai (CN); Brian Scott Jansto, Beaver Falls, PA (US); Theodore James Miller, Oakdale, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/976,619

(22) Filed: Dec. 21, 2015

(65) Prior Publication Data

US 2017/0178829 A1 Jun. 22, 2017

(51) Int. Cl.
*H01H 9/02* (2006.01)
*H01H 7/06* (2006.01)
*H01H 50/36* (2006.01)

(52) U.S. Cl.
CPC ..... *H01H 9/0271* (2013.01); *H01H 7/06* (2013.01); *H01H 50/36* (2013.01)

(58) Field of Classification Search
CPC ..... H01H 9/0271; H01H 983/14; H01H 983/144; H01H 983/22; H01H 983/226; H01H 975/10; H01H 975/12
USPC ..... 335/172
See application file for complete search history.

(56) References Cited

U.S. PATENT DOCUMENTS 3,864,649 A * 2/1975 Doyle ..... H01H 71/505 200/DIG. 42
4,215,328 A * 7/1980 Chabot ..... H01H 71/1009 335/170
4,636,760 A * 1/1987 Lee ..... H01H 89/08 335/14
4,929,920 A 5/1990 Meiners et al.
(Continued)

OTHER PUBLICATIONS

European Patent Office, "extended European search report", (corresp. to EP 16203801.2), dated Apr. 21, 2017, 8 pp.

*Primary Examiner* — Shawki S Ismail
*Assistant Examiner* — Lisa Homza
(74) *Attorney, Agent, or Firm* — Eckert Seamans; Nathaniel Wilks; Grant Coffield

(57) ABSTRACT

An electrical switching apparatus includes a housing, a line terminal, a load terminal, separable contacts disposed on a conductive path between the line terminal and the load terminal, an operating mechanism structured to open and close said separable contacts, said operating mechanism including a trip bar, and an electronic trip unit. The electrical switching apparatus also includes a trip actuator assembly including an actuator housing coupled to said housing, an actuator coupled to said actuator housing, and a connector structured to electrically connect the actuator to an electronic trip unit. The electrical switching apparatus further includes a current transformer assembly including a rod-shaped conductor electrically coupled to the load terminal and a current transformer disposed around the rod-shaped conductor, wherein the electronic trip unit is structured to electrically control actuation of the actuator.

15 Claims, 6 Drawing Sheets

(56) References Cited

U.S. PATENT DOCUMENTS

| | | | | | |
|---|---|---|---|---|---|
| 4,947,145 | A * | 8/1990 | Ohishi | H01H 71/46 | 335/14 |
| 4,975,665 | A * | 12/1990 | Ohishi | H01H 89/08 | 335/14 |
| 5,053,735 | A * | 10/1991 | Ohishi | H01H 89/08 | 335/14 |
| 5,079,529 | A * | 1/1992 | Ohishi | H01H 89/08 | 335/14 |
| 5,302,786 | A | 4/1994 | Rosen et al. | | |
| 6,307,453 | B1 * | 10/2001 | Wellner | H01H 83/20 | 335/172 |
| 6,597,266 | B1 * | 7/2003 | Rodriguez | H01H 71/0228 | 335/132 |
| 6,850,135 | B1 * | 2/2005 | Puskar | H01H 71/1009 | 335/166 |
| 8,885,313 | B2 | 11/2014 | Zhou | | |
| 9,025,298 | B2 | 5/2015 | Zhou et al. | | |
| 9,103,852 | B2 | 8/2015 | Zheng et al. | | |
| 2003/0202305 | A1 | 10/2003 | Engel et al. | | |
| 2004/0239458 | A1 * | 12/2004 | Harmon | H01H 77/02 | 335/174 |
| 2005/0023120 | A1 * | 2/2005 | Puskar | H01H 71/123 | 200/321 |
| 2005/0024173 | A1 * | 2/2005 | Puskar | H01H 71/12 | 335/172 |
| 2008/0042787 | A1 * | 2/2008 | McCoy | H01H 71/04 | 335/186 |
| 2008/0088991 | A1 * | 4/2008 | Elms | H01H 71/162 | 361/42 |
| 2008/0135390 | A1 * | 6/2008 | McCoy | H01H 1/54 | 200/331 |
| 2010/0085136 | A1 | 4/2010 | Carlino et al. | | |

* cited by examiner

ELECTRICAL SWITCHING APPARATUS WITH ELECTRONIC TRIP UNIT

BACKGROUND

Field

The disclosed concept pertains generally to electrical switching apparatus, such as, for example, circuit breakers.

Background Information

Electrical switching apparatus are used to protect electrical circuitry from damage due to a trip condition, such as, an overcurrent condition, an undervoltage condition, a relatively high level short circuit or fault condition, a ground fault or an arc fault condition. Compact molded case circuit breakers (compact MCCBs), for example, include at least one pair of separable contacts which are operated either manually by way of a handle disposed on the outside of the case, or automatically by way of a trip unit in response to the trip condition.

Compact MCCBs include a thermal-magnetic trip mechanism. The thermal aspect of the trip mechanism includes a bimetal piece through which current flows. An increase in current causes the temperature of the bimetal piece to rise, which in turn causes it to bend. When the bimetal piece bends a sufficient amount, it causes the compact MCCB to trip. The thermal aspect of the trip mechanism provides a long delay trip function, which is often triggered by a sustained overcurrent condition.

The magnetic aspect of the trip mechanism includes a magnetic clapper structure through which current flows. When the current increases above a threshold level, a magnetic field induced by the current flowing through the magnetic clapper structure causes an associated cantilever to move. The movement of the cantilever causes the compact MCCB to trip. The magnetic aspect of the trip mechanism provides an instantaneous trip function.

Many types of circuit breakers include an electronic trip unit (ETU). The ETU receives input from one or more sensors, such as a current transformer (CT) to sense current, located either in a circuit breaker or outside of a circuit breaker and determines whether a fault condition occurs. The ETU can control whether to trip open the separable contacts of the circuit breaker. The ETU also allows users to modify trip settings, such as a current at which the circuit breaker will trip or the delay time before tripping the circuit breaker. Power to operate the ETU is provided by a CT disposed around a conductor in the circuit breaker or outside of the circuit breaker. The CT is also used to sense current flowing through the circuit breaker. A relatively large size CT is required to accurately sense current over a wide range.

Compact MCCBs are small and the existing components in prior compact MCCBs do not leave enough room to incorporate an ETU or its associated components, such as a CT. As such, ETUs have not been incorporated into compact molded case circuit breakers.

FIG. 1 is an isometric view of a conventional compact MCCB 100 and

FIG. 2 is a cross-sectional view of the compact MCCB 100 of FIG. 1. As shown in FIGS. 1 and 2, the compact MCCB 100 does not include an ETU or its associated components. Due to the limited space and configuration of components inside the compact MCCB 100, an ETU and its associated components, such as a CT, cannot be incorporated into the compact MCCB 100.

There is room for improvement in electrical switching apparatus.

SUMMARY

These needs and others are met by embodiments of the disclosed concept, which are directed to an electrical switching apparatus including an electronic trip unit and a current transformer.

In accordance with aspects of the disclosed concept, an electrical switching apparatus comprises: a housing; a line terminal; a load terminal; separable contacts disposed on a conductive path between the line terminal and the load terminal; an operating mechanism structured to open and close said separable contacts, said operating mechanism including a trip bar; an electronic trip unit; a trip actuator assembly including: an actuator housing coupled to said housing; an actuator coupled to said actuator housing; and a connector structured to electrically connect the actuator to an electronic trip unit; and a current transformer assembly including: a rod-shaped conductor electrically coupled to the load terminal; and a current transformer disposed around the rod-shaped conductor, wherein the electronic trip unit is structured to electrically control actuation of the actuator.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
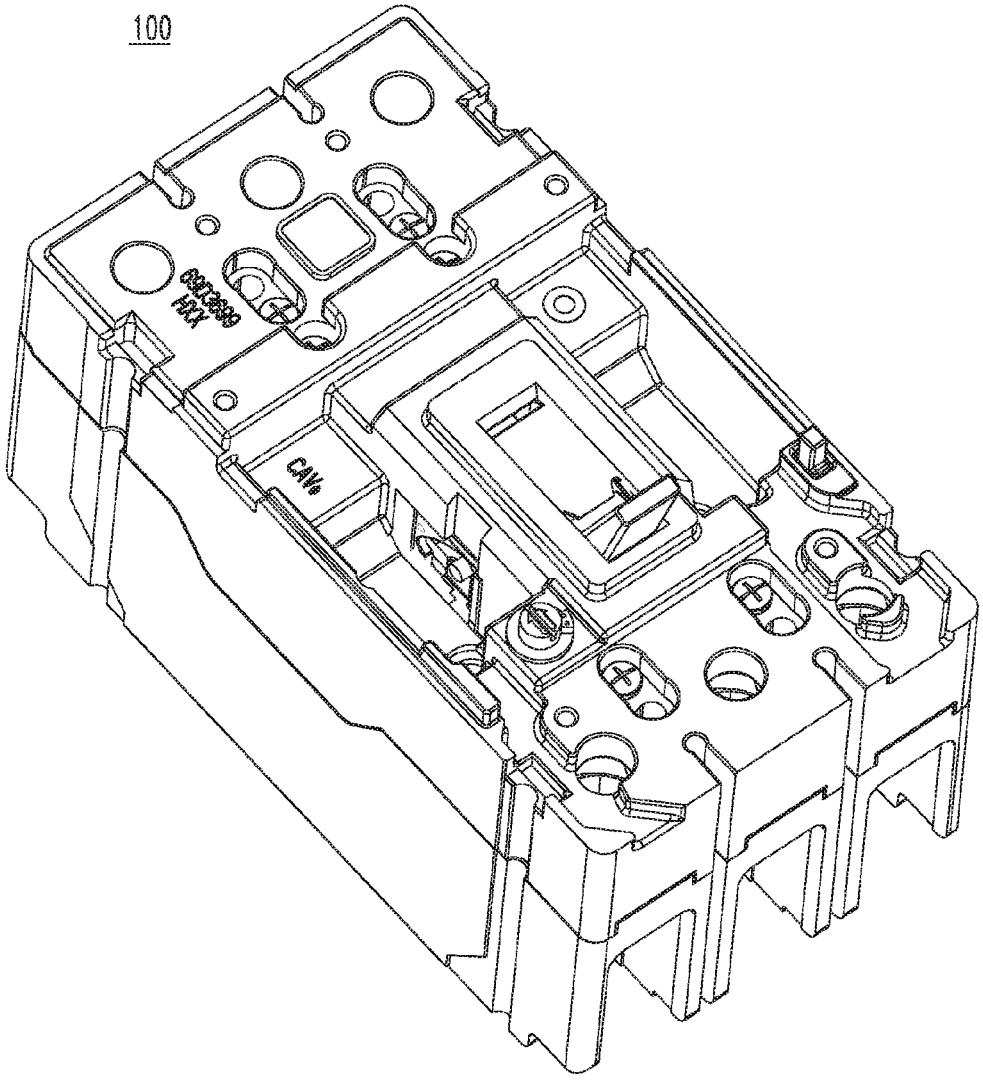
FIG.1 (PRIOR ART)
FIG. 1 is an isometric view of a conventional compact MCCB design.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

As employed herein, the term "processor" shall mean a programmable analog and/or digital device that can store, retrieve and process data; a controller; a control circuit; a computer; a workstation; a personal computer; a microprocessor; a microcontroller; a microcomputer; a central processing unit; a mainframe computer; a mini-computer; a server; a networked processor; or any suitable processing device or apparatus.

Figure 3:
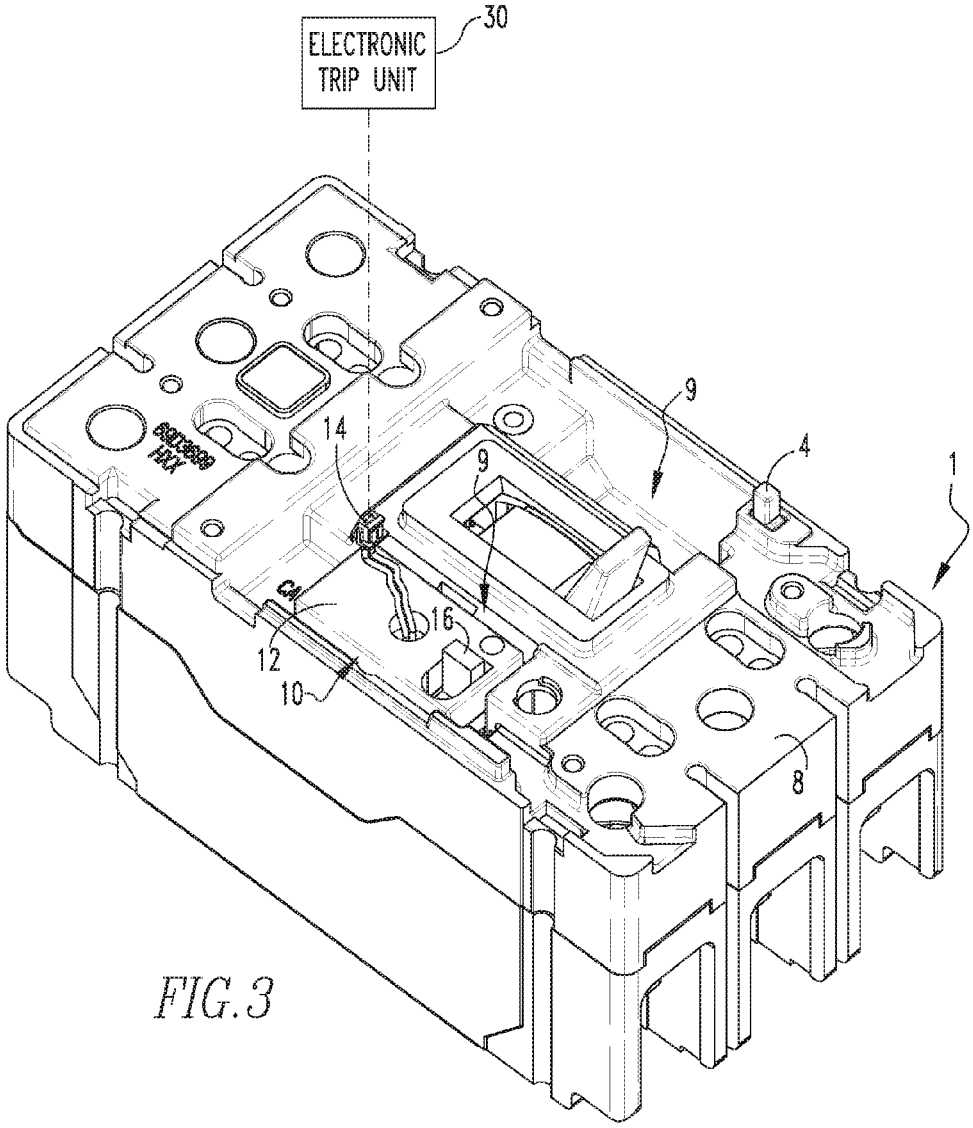
FIG. 3 is an isometric view of a compact MCCB in accordance with an example embodiment of the disclosed concept.
Figure 4:
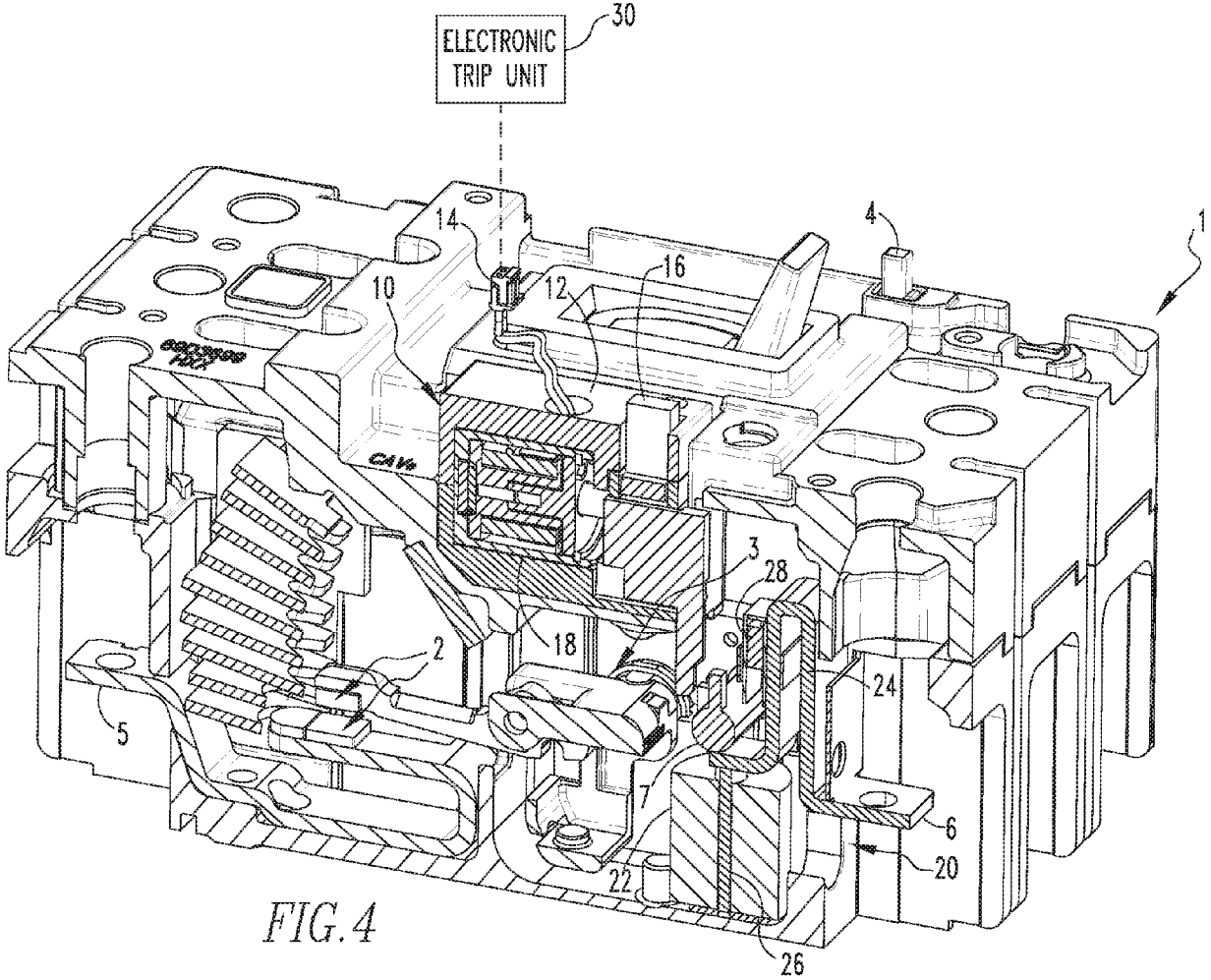
FIG. 4 is an isometric cross-sectional view of the compact MCCB of FIG. 3.
Figure 5:
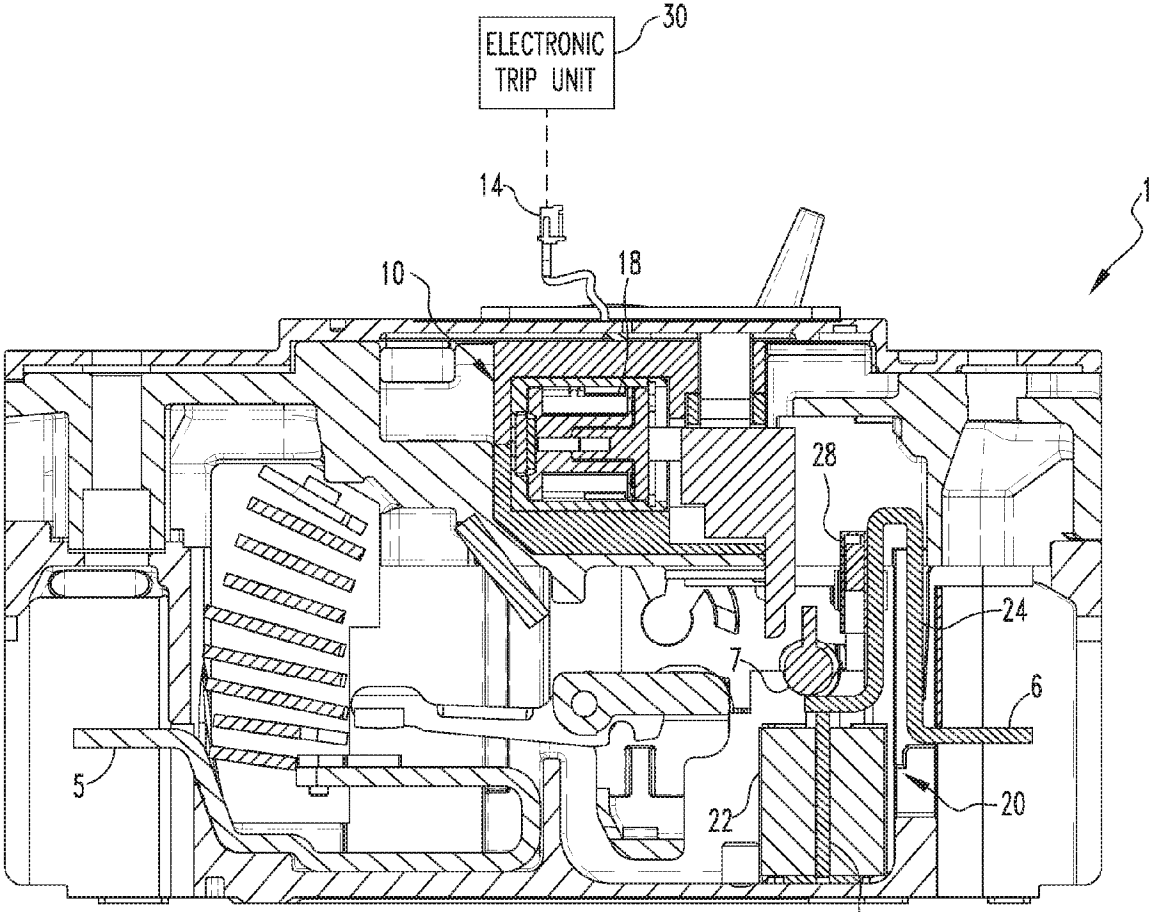
FIG. 5 is a side elevation cross-sectional view of the compact MCCB of FIG. 3.
Figure 6:
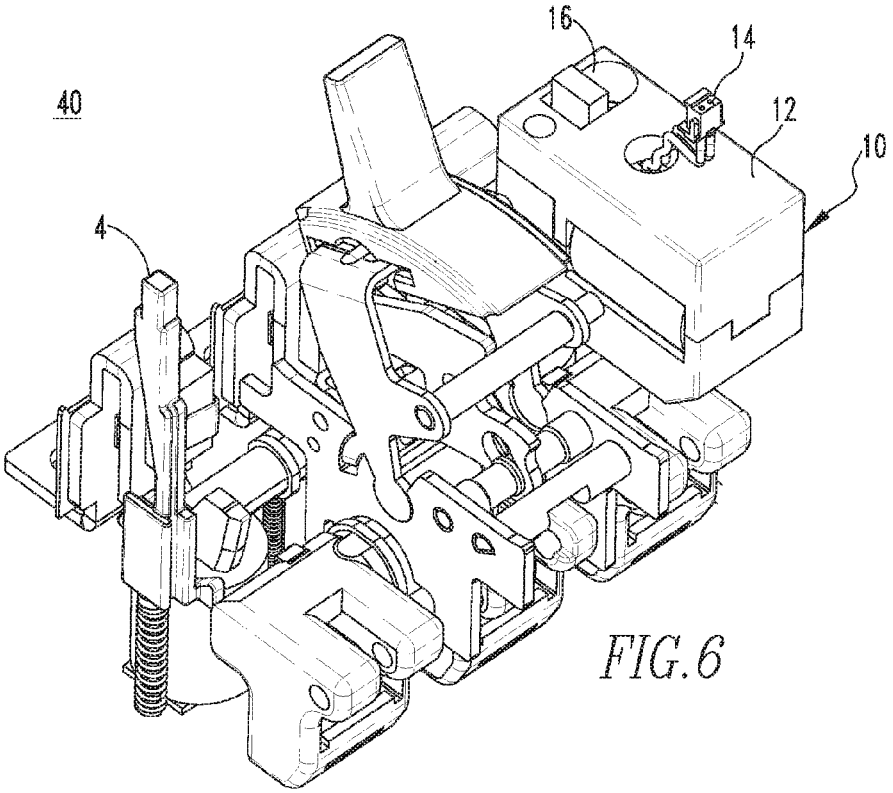
FIG. 6 is an isometric view of an operating assembly included in the compact MCCB of FIG. 3.
Figure 7:
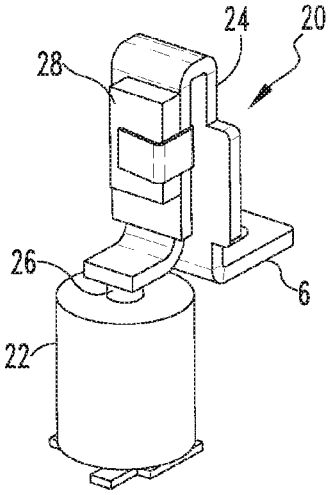
FIG. 7 is an isometric view of a CT assembly included in the compact MCCB of FIG. 3.
Figure 8:
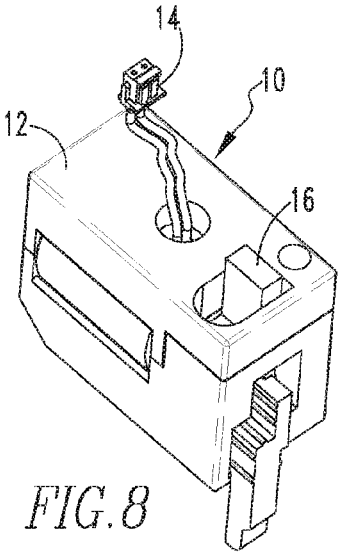
FIG. 8 is an isometric view of a trip actuator assembly included in the compact MCCB of FIG. 3.

FIGS. 3 through 8 show an electrical switching apparatus (e.g., without limitation, a compact MCCB 1) in accordance with an example embodiment of the disclosed concept. FIG. 3 is an isometric view of the compact MCCB 1. FIG. 4 is an isometric cross-sectional view of the compact MCCB 1. FIG. 5 is a cross-sectional view of the compact MCCB 1. FIG. 6 is an isometric view of an operating assembly 40 included in the compact MCCB 1. FIG. 7 is an isometric view of a CT assembly 20 included in the compact MCCB 1, and FIG. 8 is an isometric view of a trip actuator assembly 10 included in the compact MCCB 1.

The compact MCCB 1 includes a housing 8 that substantially forms an exterior shape of the compact MCCB 1 and houses many of the components of the compact MCCB 1. The compact MCCB 1 further includes a line terminal 5 and a load terminal 6. The line terminal 5 is structured to be electrically connected to a power source (not shown) and the load terminal is structured to be electrically connected to a load (not shown). The line terminal 5 and the load terminal 6 are electrically connected by a conductive path passing through the compact MCCB 1. Separable contacts 2 are disposed on the conductive path between the line terminal 5 and the load terminal 6. The line terminal 5 and the load terminal 6 are electrically connected to each other when the separable contacts 2 are closed. However, opening the separable contacts 2 (e.g., without limitation, tripping open the separable contacts 2) electrically disconnects the line terminal 5 from the load terminal 6.

The compact MCCB 1 further includes an operating mechanism 3. The operating mechanism 3 is structured to open and close the separable contacts 2. The operating mechanism 3 opens and closes the separable contacts 2 in response to rotation of a trip bar 7 included in the compact MCCB 1. Rotation of the trip bar 7 may be initiated via, for example, a trip push button 4, a reset push button 16 or a trip actuator 18 included in the compact MCCB 1. The trip push button 4 is structured to be accessible from the exterior of the compact MCCB 1. The trip push button 4 is structured such that its actuation by a user causes the trip push button 4 to interact with the trip bar 7 such that the trip bar 7 rotates and causes the operating mechanism 3 to open the separable contacts 2. The reset push button 16 is structured to be accessible from the exterior of the compact MCCB 1. The reset push button 16 is structured such that its actuation by a user causes the reset push button 16 to reset the trip actuator 18. The trip actuator 18 is structured to be electrically connected to and controlled by an ETU 30. The trip actuator 18 is structured to interact with the trip bar 7 under control of the ETU 30 and to cause the trip bar 7 to rotate and cause the operating mechanism 3 to open the separable contacts 2. In some example embodiments of the disclosed concept, the trip actuator 18 is a solenoid.

The housing 8 of the compact MCCB 1 includes two auxiliary pockets 9 formed in its topside (e.g., without limitation, from the perspective of FIGS. 3-5). As shown in FIG. 3, one of the auxiliary pockets 9 is empty. The trip actuator assembly 10 is disposed in the other of the auxiliary pockets 9. Although one of the auxiliary pockets 9 is illustrated as empty in FIG. 3, it will be appreciated by those having ordinary skill in the art that the ETU 30 may be disposed in one of the auxiliary pockets 9. It is also contemplated that the ETU 30 may be disposed on the topside of the housing 8 in some example embodiments of the disclosed concept.

The trip actuator assembly 10 includes an actuator housing 12, the trip actuator 18, a connector 14 and the reset push button 16. The actuator housing 12 is structured to couple to the housing 8 in one of the auxiliary pockets 9. In some example embodiments of the disclosed concept, the actuator housing 12 is structured to have an exterior shape that substantially corresponds with the shape of the auxiliary pocket 9 it is disposed in. The trip actuator 18 is coupled to and disposed inside of the actuator housing 12. The trip actuator 18 is structured to electrically connect to the ETU 30 via the connector 14. In some example embodiments of the disclosed concept, the actuator housing 12 includes an aperture formed therein such that the connector can pass through the aperture to electrically connect to the ETU 30 located outside of the actuator housing 12.

The CT assembly 20 (FIG. 7) includes the load terminal 6, a CT 22, a flat conductor 24, a rod-shaped conductor 26 and a thermal diode 28. The flat conductor 24 and the rod-shaped conductor 26 form part of the conductive path between the line terminal 5 and the load terminal 6. The flat conductor 24 is electrically connected between the load terminal 6 and the rod-shaped conductor 26. The CT 22 is disposed around the rod-shaped conductor 26 and the thermal diode 28 is disposed against the flat conductor 24.

The CT 22 and the thermal diode 28 are electrically connected to the ETU 30 via different connectors. The CT 22 is structured to sense a magnitude of the current flowing through the rod-shaped conductor 26 and provide the sensed magnitude to the ETU 30. The CT 22 is also structured to use the current flowing through the rod-shaped conductor 26 to provide power to the ETU 30. The ETU 30 uses the power provided from the CT 22 to power its own operation. The thermal diode 28 is structured to sense a temperature of the flat conductor 24 and to provide the sensed temperature to the ETU 30. With the magnitude of current sensed by the CT 22 and the temperature sensed by the thermal diode 28, the ETU 30 is able to provide instantaneous and delayed trip functions similar to those provided by thermal-magnetic trip units found in convention compact MCCBs. Furthermore, the components associated with thermal-magnetic trip units, such as a bimetal piece and a magnetic clapper structure located on the main conductive path are not needed, and therefore may be omitted from the compact MCCB 1 of example embodiments of the disclosed concept.

The ETU 30 controls the trip actuator 18 to initiate tripping open the separable contacts 2. In accordance with some example embodiments of the disclosed concept, the ETU 30 controls the trip actuator 18 based on the magnitude of current sensed by the CT 22 and/or the temperature sensed by the thermal diode 28. In accordance with some example embodiments of the disclosed concept, the ETU 30 includes only an analog circuit or a processor, an associated memory and an analog circuit. The processor may be, for example and without limitation, a microprocessor, a microcontroller, or some other suitable processing device or circuitry. The memory may be any of one or more of a variety of types of internal and/or external storage media such as, without limitation, RAM, ROM, EPROM(s), EEPROM(s), FLASH, and the like that provide a storage register, i.e., a machine readable medium, for data storage such as in the fashion of an internal storage area of a computer, and can be volatile memory or nonvolatile memory. It will be appreciated by those having ordinary skill in the art that the ETU 30 may provide additional functionality beyond that provided by conventional thermal-magnetic trip units. For example and without limitation, the ETU 30 may have adjustable settings that can be used to adjust tripping characteristics of the compact MCCB 100 such as, without limitation, the full load ampere setting ("Ir"), the long delay time ("LDT"), the short delay pickup ("SDPU") and the short delay time ("SD Time") of the compact MCCB 1.

Figure 2:
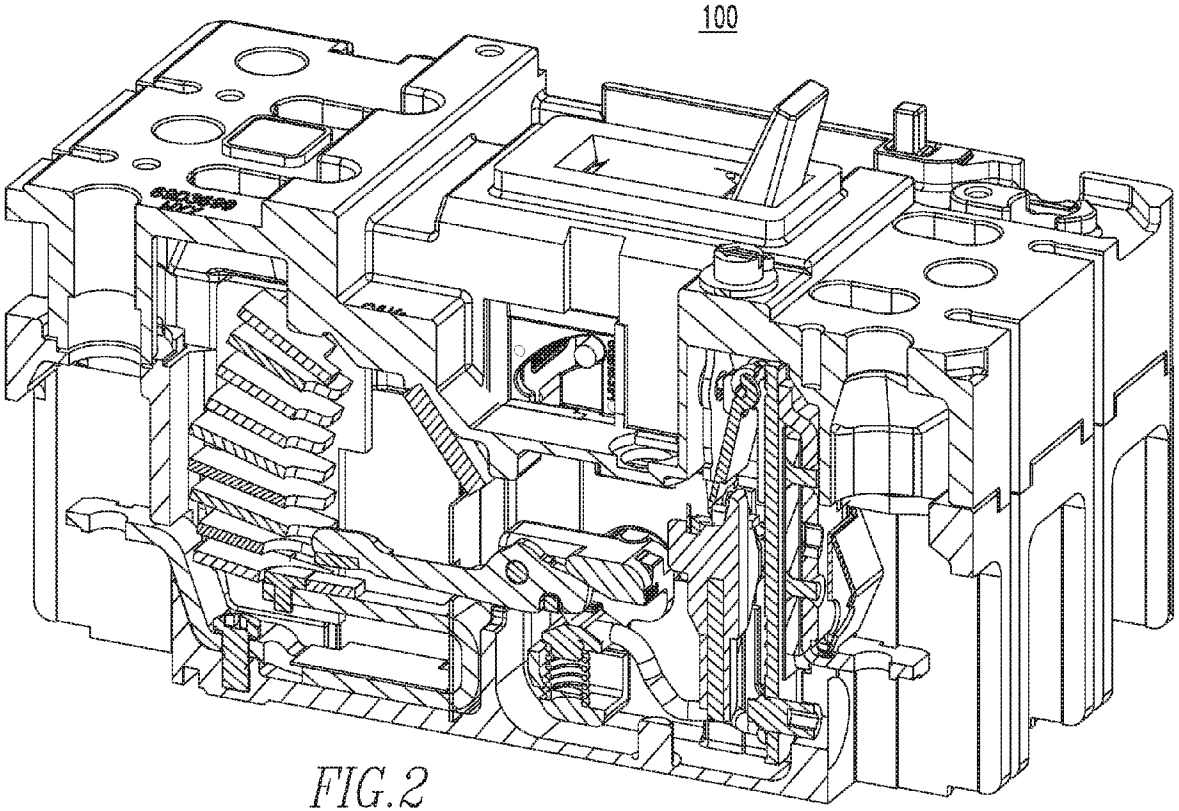
FIG. 2 (PRIOR ART)
FIG. 2 is a cross-sectional view of the conventional compact MCCB of FIG. 1

In example embodiments of the disclosed concept, the compact MCCB 1 has various differences from the conventional compact MCCB 100 shown in FIGS. 1 and 2. For instance, the conventional MCCB 100 includes a thermal-magnetic trip unit that includes a bimetal piece and a magnetic clapper structure that interact with a trip bar to initiate a trip. In contrast, the compact MCCB 1 includes the ETU 30 which controls the trip actuator 18 to interact with the trip bar 7 to initiate a trip. Furthermore, components of the thermal-magnetic trip unit of the conventional compact MCCB 100 are located in a bottom portion of its housing, as shown in FIGS. 1 and 2. In the compact MCCB 1 of example embodiments of the disclosed concept, the bottom portion of the interior of the housing 8 does not include components of a thermal-magnetic trip unit. Rather, the space is used for the CT assembly 20. Moreover, a combination of the flat conductor 24 and rod-shaped conductor 24 are used to provide a flat surface for the thermal diode 28 to be mounted on and a round surface for the CT 22 to be disposed around. Finally, since the compact MCCB 1 uses the ETU 30, rather than a thermal-magnetic trip unit, the compact MCCB 1 is able to provide a functionality similar to a conventional thermal-magnetic trip unit as well as more advanced functions such as adjustable settings.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:
- a housing including a number of auxiliary pockets;
- a line terminal;
- a load terminal;
- separable contacts disposed on a conductive path between the line terminal and the load terminal;
- an operating mechanism structured to open and close said separable contacts, said operating mechanism including a trip bar;
- an electronic trip unit;
- a trip actuator assembly including:
  - an actuator housing coupled to said housing;
  - an actuator coupled to said actuator housing; and
  - a connector structured to electrically connect the actuator to an electronic trip unit; and
- a current transformer assembly including:
  - a rod-shaped conductor electrically coupled to the load terminal; and
  - a current transformer disposed around the rod-shaped conductor,
- wherein the electronic trip unit is structured to electrically control actuation of the actuator, and
- wherein the separable contacts, the operating mechanism, and the current transformer are disposed in an interior of the housing and the trip actuator assembly is disposed in one of the auxiliary pockets on an exterior of the housing.

2. The electrical switching apparatus of claim 1, wherein the electrical switching apparatus is a compact molded case circuit breaker.

3. The electrical switching apparatus of claim 1, wherein a shape of the actuator housing corresponds to a shape of the auxiliary pocket the trip actuator assembly is disposed in.

4. The electrical switching apparatus of claim 1, wherein the electronic trip unit is disposed in another one of the auxiliary pockets.

5. The electrical switching apparatus of claim 1, wherein the trip actuator assembly further includes a reset push button structured to reset the actuator.

6. The electrical switching apparatus of claim 1, wherein the trip actuator is structured to interact with the trip bar to cause the operating mechanism to open the separable contacts.

7. The electrical switching apparatus of claim 1, wherein the actuator assembly includes an aperture formed therein, and wherein the connector is structured to extend through the aperture to electrically connect to the electronic trip unit.

8. The electrical switching apparatus of claim 1, wherein the current transformer is electrically connected to the electronic trip unit via the connector, and wherein the current transformer is structured to sense a magnitude of current flowing between the line terminal and the load terminal and to provide the sensed magnitude to the electronic trip unit.

9. The electrical switching apparatus of claim 8, wherein the current transformer is structured to provide power to the electronic trip unit.

10. The electrical switching apparatus of claim 1, wherein the current transformer assembly includes a flat conductor electrically connected between the load terminal and the rod-shaped conductor.

11. The electrical switching apparatus of claim 10, wherein the current transformer is disposed in a bottom portion of an inside of the housing, and wherein the rod-shaped conductor extends from the flat conductor toward a bottom surface of the housing.

12. The electrical switching apparatus of claim 10, wherein the current transformer assembly further includes a temperature sensor structured to sense a temperature of the flat conductor, and wherein the temperature sensor is disposed on the flat conductor.

13. The electrical switching apparatus of claim 12, wherein the temperature sensor is a thermal diode.

14. The electrical switching apparatus of claim 1, further comprising:
- a push-to-trip button structured to interact with the trip bar to cause the operating mechanism to open the separable contacts.

15. The electrical switching apparatus of claim 1, wherein the electronic trip unit is structured to adjust trip characteristics of the electrical switching apparatus.

* * * * *